US008322077B2

(12) United States Patent
Papanikolaou et al.

(10) Patent No.: US 8,322,077 B2
(45) Date of Patent: Dec. 4, 2012

(54) VEHICLE DOOR HANDLE WITH INERTIA LOCK MECHANISM

(75) Inventors: Kosta Papanikolaou, Huntington Woods, MI (US); Venky Krishnan, Canton, MI (US); Jeff Stokes, Milan, MI (US); Cort Corwin, Grand Haven, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 322 days.

(21) Appl. No.: 12/623,762

(22) Filed: Nov. 23, 2009

(65) Prior Publication Data

US 2011/0120022 A1 May 26, 2011

(51) Int. Cl.
*E05B 1/00* (2006.01)

(52) U.S. Cl. ..... 49/460; 49/503; 292/93; 292/336.3; 292/DIG. 22

(58) Field of Classification Search ..... 49/460, 49/503; 292/92, 336.3, DIG. 65, DIG. 22; 296/146.1, 187.12
See application file for complete search history.

(56) References Cited

U.S. PATENT DOCUMENTS

| | | | | |
|---|---|---|---|---|
| 3,583,741 | A | 6/1971 | Breitschwerdt | |
| 3,601,434 | A * | 8/1971 | Fargo et al. | 292/50 |
| 4,536,021 | A * | 8/1985 | Mochida | 292/201 |
| 4,819,493 | A | 4/1989 | Dornan | |
| 5,613,717 | A * | 3/1997 | Ha | 292/336.3 |
| 5,669,642 | A | 9/1997 | Kang | |
| 5,865,481 | A | 2/1999 | Buschmann | |
| 6,116,664 | A * | 9/2000 | Wegner | 292/216 |
| 6,382,688 | B1 | 5/2002 | Agostini | |
| 6,695,362 | B2 * | 2/2004 | Kluting et al. | 292/216 |
| 7,070,216 | B2 * | 7/2006 | von zur Muehlen | 292/336.3 |
| 7,198,307 | B2 | 4/2007 | Drysdale et al. | |
| 7,201,405 | B2 | 4/2007 | Le et al. | |
| 7,311,350 | B2 * | 12/2007 | Mitsui et al. | 296/146.9 |
| 7,341,291 | B2 * | 3/2008 | Ooe et al. | 292/336.3 |
| 7,407,203 | B2 | 8/2008 | Huizenga et al. | |
| 7,635,151 | B2 * | 12/2009 | Rodawold et al. | 292/336.3 |
| 2006/0261603 | A1 * | 11/2006 | Cetnar et al. | 292/216 |
| 2008/0111381 | A1 * | 5/2008 | Merideth et al. | 292/137 |
| 2009/0243307 | A1 * | 10/2009 | Lee | 292/93 |

* cited by examiner

*Primary Examiner* — Katherine W Mitchell
*Assistant Examiner* — Marcus Menezes
(74) *Attorney, Agent, or Firm* — Jason Rogers; Price Heneveld LLP

(57) ABSTRACT

A door handle assembly includes a door handle that engages a bell crank to actuate a door release latch. A locking member moves relative to the bell crank, and shifts to a locked position wherein the locking member engages an engagement member to prevent rotation of the bell crank when the door handle assembly experiences an inertial force due to an impact or the like.

11 Claims, 9 Drawing Sheets

VEHICLE DOOR HANDLE WITH INERTIA LOCK MECHANISM

FIELD OF THE INVENTION

This invention relates to vehicle doors, and more particularly relates to an inertial locking mechanism for vehicle doors.

BACKGROUND OF THE INVENTION

Vehicle doors typically include a movable handle that is operably connected to a door latch. In use, a user moves the handle to thereby release the latch to permit opening of the door.

During an impact with another vehicle, the mass of the door handle may generate a force tending to move the handle to the open position due to the acceleration caused by the impact. Various mechanisms have been developed to prevent unwanted release of a door handle during a vehicle impact. However, the cost, packaging, and engineering difficulties associated with known devices may be significant.

SUMMARY OF THE INVENTION

One aspect of the present assembly is a vehicle door assembly including a door structure and an engagement member fixed to the door structure. A handle is movably mounted to the door structure for movement between a first position and an actuated position. A crank member is rotatably mounted to the door structure for rotation about an axis extending through the engagement member. The crank member operably engages the handle such that the handle causes the crank member to rotate from a first position to an actuated position. A door latch is operably connected to the crank member whereby movement of the crank member to the actuated position releases the door latch. The door assembly further includes a lock member pivotably mounted to the crank member for movement between first and second positions relative to the crank member. The lock member further defines an intermediate position between the first and second positions, and the lock member is biased towards the intermediate position. The lock member is configured to move to the first and second positions upon application of inertial forces in first and second directions, respectfully, to the lock member. The lock member engages the engagement member when the lock member is in the first and second positions and restricts movement of the crank member such that the door latch cannot be released by the crank member even if inertial forces are applied in the first and second directions.

In the foregoing description, it will be readily appreciated by those skilled in the art that modifications may be made to the invention without departing from the concepts disclosed herein. Such modifications are to be considered as included in the following claims, unless these claims by their language expressly state otherwise.

BRIEF DESCRIPTION OF THE DRAWINGS

FIG. 9 is a partially schematic view of a door handle assembly according to another aspect of the present invention wherein the door handle assembly has not been manually actuated, and wherein the door handle assembly has also not been subject to an inertial force due to impact or the like;

DETAILED DESCRIPTION OF PREFERRED EMBODIMENT

Figure 1:
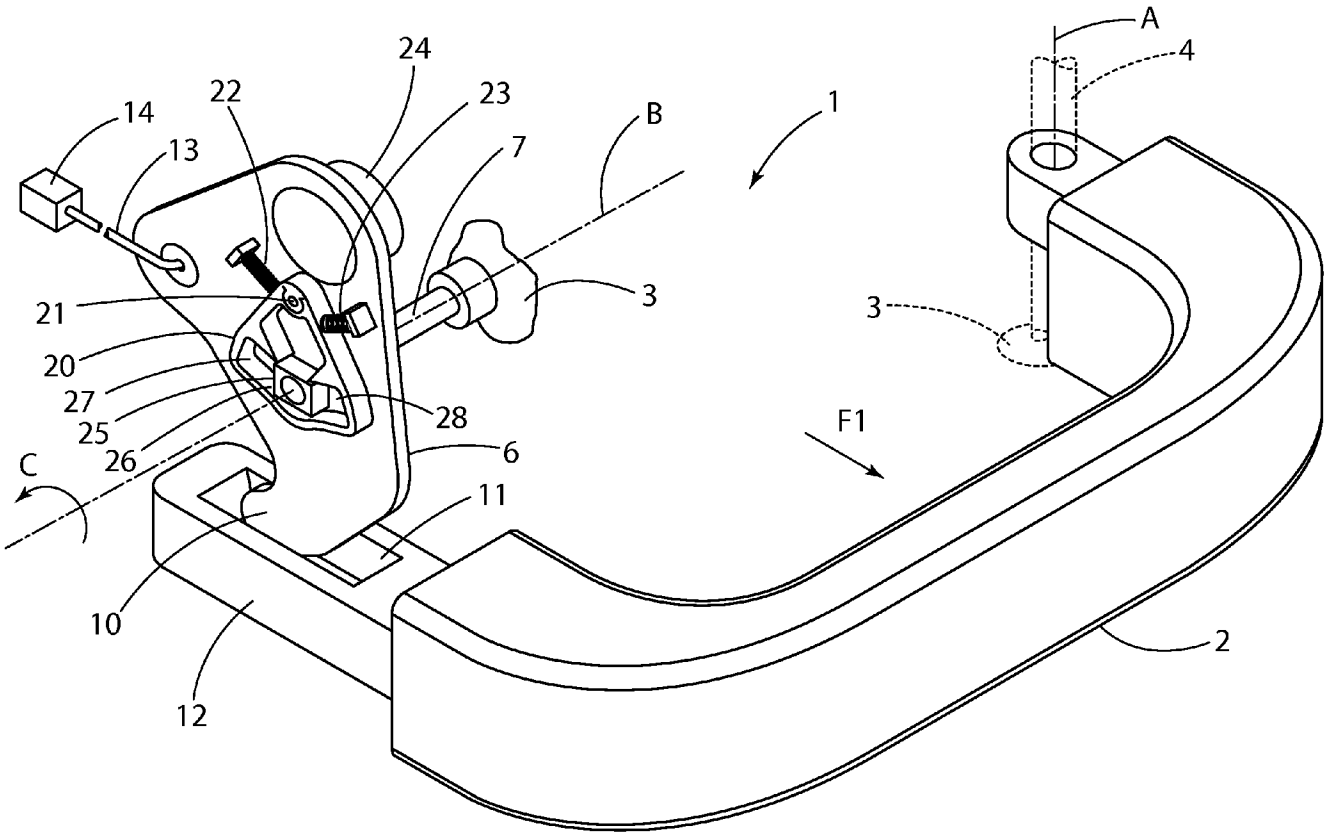
FIG. 1 is a partially fragmentary isometric view of a door handle assembly according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIG. 1, a door handle assembly 1 according to one aspect of the present invention includes a handle member 2 that is pivotably mounted to a vehicle door structure 3 by a pin 4 or the like for rotation about a generally vertical axis "A." A bell crank 6 is rotatably connected to door structure 3 by a shaft or pin 7 for rotation relative to the door structure 3 about a generally horizontal axis "B."

An end portion 10 of bell crank 6 is received in a cavity 11 of end portion 12 of handle 2, and a linkage 13 operably interconnects the bell crank 6 to a door latch 14. In use, a user grasps the handle member 2, pulling it outwardly such that it rotates about axis A, thereby causing bell crank 6 to rotate about axis B to shift linkage 13 and release door latch 14 (see also FIG. 4). The linkage 13 may comprise one or more rigid links, or it may comprise a Bowden cable or other suitable connecting arrangement. The door latch 14 may comprise a conventional door latch according to one of many known designs, and the details of the door latch 14 are not therefore described in detail herein.

As described in more detail below in connection with FIG. 5, a clutch plate or locking member 20 is rotatably mounted to the bell crank 6 at a pin or pivot 21 such that the locking member 20 pivots relative to bell crank 6 about pivot 21. A pair of springs 22 and 23 bias the locking member 20 towards the neutral or rest position shown in FIG. 1. An engagement member 25 is received in a cavity 26 of lock member 20. In the event of an impact, an inertial force "F1" is generated on handle 2 (if the handle assembly 1 is viewed in a non-inertial reference frame), and this force tends to rotate handle member 2 outwardly towards the open position about the axis A. During impact, an optional weight 24 on bell crank 6 generates a force in the direction of the arrow F1, such that the forces due to weight 24 counter act, at least to some extent, the force of handle member 2 tending to rotate bell crank 6 in the direction of the arrow "C" which would otherwise shift linkage 13 to release door latch 14. Also, impact force F1 (FIG. 5) causes lock member 20 to rotate about pin 21 such that engagement member 25 is positioned in end portion 27 of cavity 26 of lock member 20, thereby preventing rotation of bell crank 6 about axis B. As also described in more detail below, lock member 20 and engagement member 25 thereby prevent rotation of bell crank 6 to prevent actuation/release of latch 14 in the event of an impact.

Figure 2:
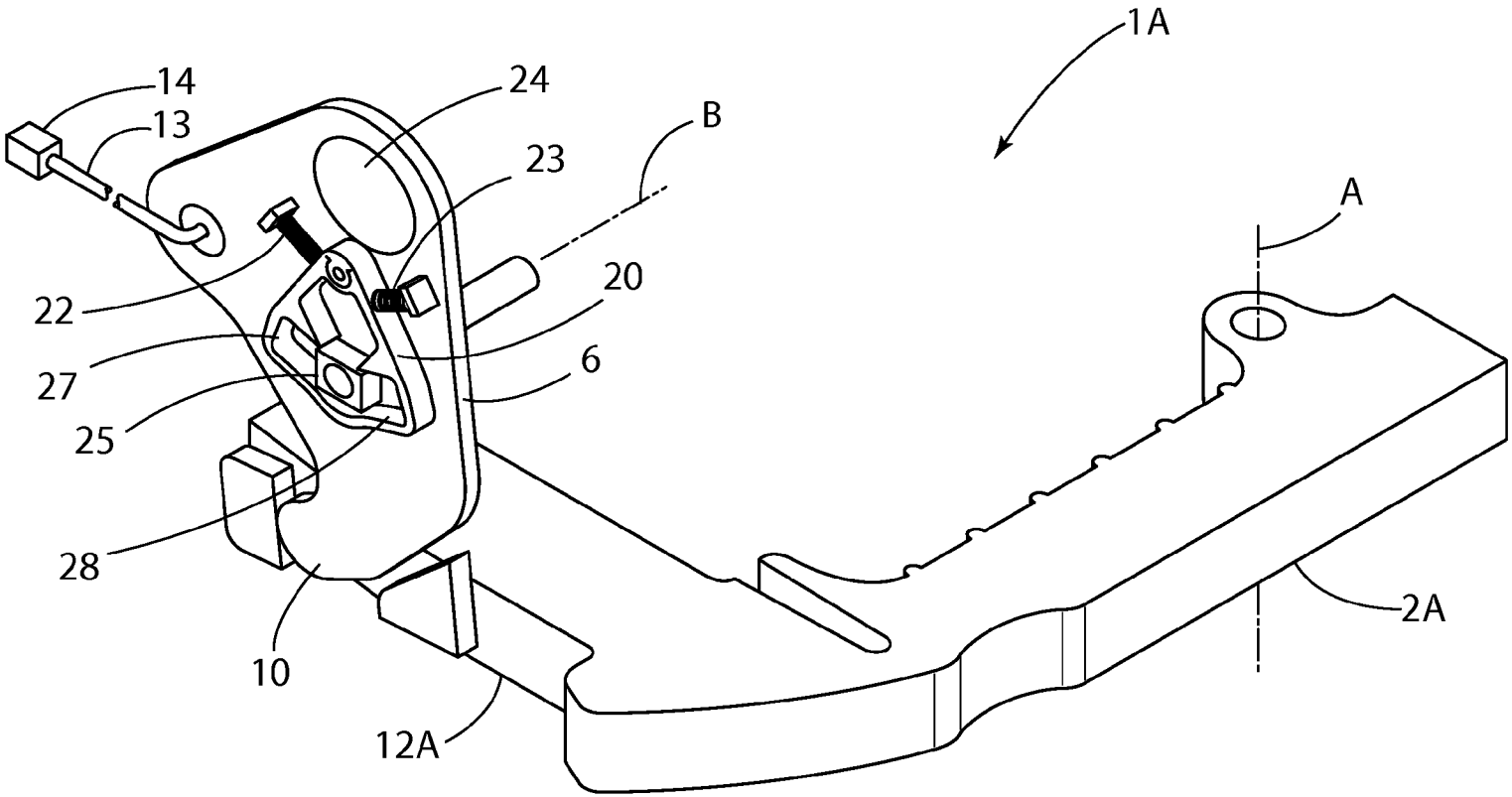
FIG. 2 is a partially fragmentary isometric view of a door handle assembly according to another aspect of the present invention.

Another embodiment 1A of the door handle assembly is shown in FIG. 2. Although the components are configured somewhat differently, handle assembly 1A operates in substantially the same manner as handle assembly 1. Door handle assembly 1A includes a handle member 2A that is pivotably mounted to door structure 3 for rotation about axis A, and a bell crank 6 that is rotatably mounted to the door structure 3 for rotation about an axis B. The end portion 12A of handle member 2A engages bell crank 6 in substantially the same manner as described in more detail above in connection with the door handle assembly 1 of FIG. 1.

FIGS. 3-8 further illustrate the operation of door handle assembly 1A of FIG. 2 (and the door handle assembly 1 of FIG. 1). In FIG. 2, bell crank 6 rotates about a horizontal axis B, and door handle 2A rotates about a vertical axis A. This is a preferred orientation of bell crank 6 and handle 2A when installed in a vehicle door. Although, axes A and B are shown as being in parallel (i.e. vertical) in FIGS. 1-8, this configuration is primarily utilized for purposes of describing the operation of door handle assemblies 1 and 1A. It will be understood that the bell crank 6 and handle 2 may have various configurations and orientations depending upon the requirements for a particular application.

Figure 3:
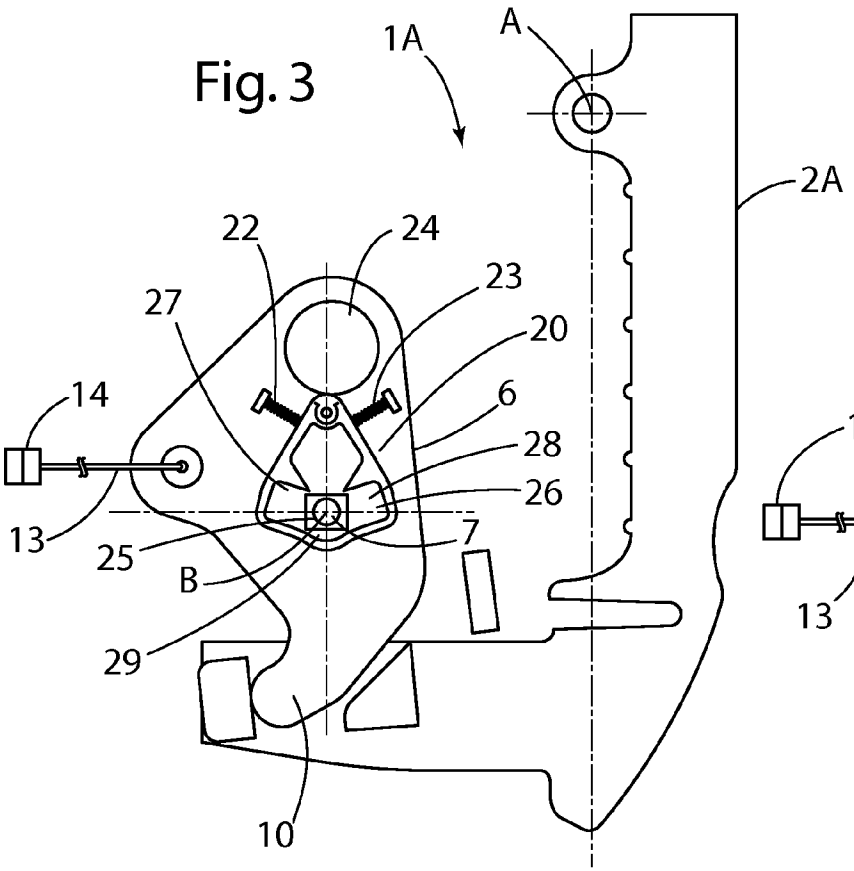
FIG. 3 is a partially schematic view of a door handle assembly according to another aspect of the present invention wherein the door handle has not been actuated by a user, and wherein the door handle assembly is not subjected to acceleration due to impact.

With reference to FIG. 3, when the door handle assembly 1A is at rest (i.e. the door handle assembly 1A is not subject to an acceleration due to impact, and a user has not pivoted the handle member 2A outwardly), the bell crank 6 is located in a center position due to the centering bias created by springs 22 and 23. Also, engagement member 25 is positioned in a central portion 29 of cavity 26 of lock member 20. As discussed above, engagement member 25 is fixed (non-rotatably) to the vehicle door structure 3 (FIG. 1), and the bell crank 6 rotates about the axis B formed by shaft or pin 7 of engagement member 25.

Figure 4:
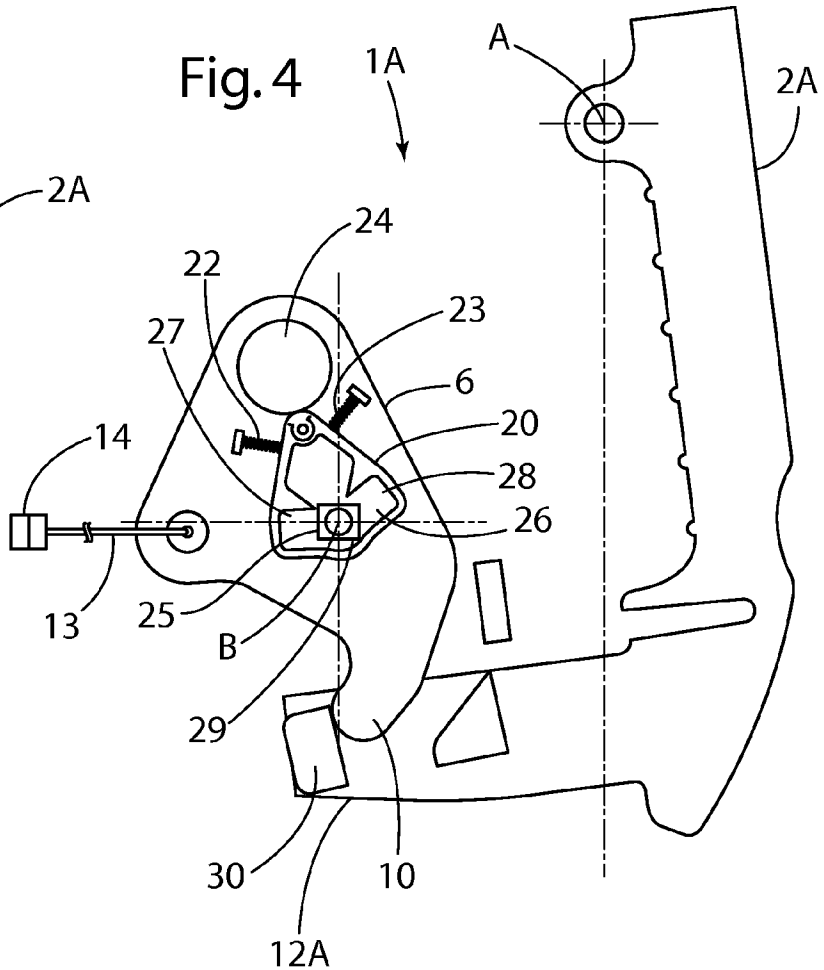
FIG. 4 is a partially schematic view of the door handle assembly of FIG. 3 wherein the door handle has been manually pulled outwardly by a user to release the door latch.

With further reference to FIG. 4, when a user pulls on the handle 2A, the handle 2A will rotate outwardly about the axis A, and protrusion 30 of end portion 12A of handle 2A contacts end portion 10 of bell crank 6, thereby rotating the bell crank 6 about axis B. Lock member 20 rotates with the bell crank 6 due to the bias of springs 22 and 23, such that engagement member 25 remains positioned in the central portion 29 of cavity 26 of lock member 20. The enlarged central portion 29 of cavity 26 of lock member 20 permits unrestricted rotation of lock member 20 about engagement member 25, provided lock member 20 has not rotated relative to bell crank 6. As the bell crank 6 rotates, a tension force on linkage 13 is generated, and the linkage 13 shifts to thereby release door latch 14. Although the linkage 13 is illustrated as being in tension due to rotation of bell crank 6, it will be recognized that the linkage 13 could be placed in compression if required for a particular application. Thus, during normal use, when a user grasps and pulls handle 2A, the lock member 20 and bell crank 6 rotate together to provide release of door latch 14, and lock member 20 does not engage engagement member 25 in a manner that would restrict rotation of bell crank 6.

Figure 5:
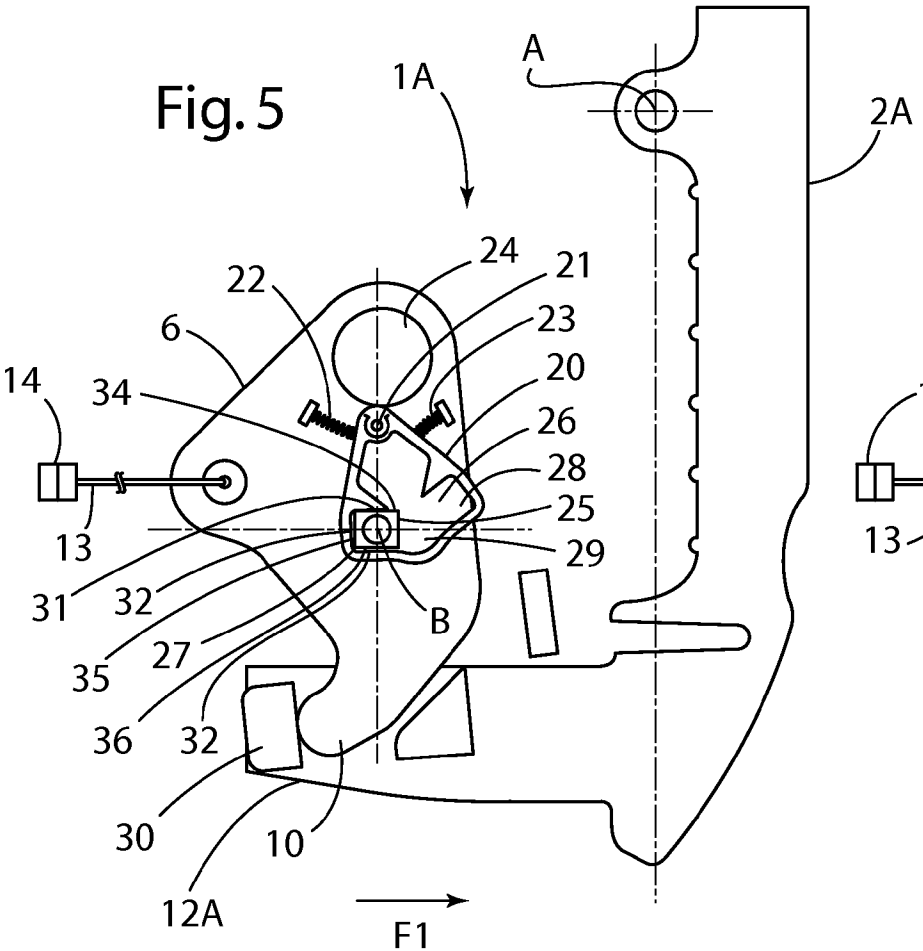
FIG. 5 is a partially schematic view of the door handle assembly of FIG. 3 wherein the door handle assembly is shown in a non-inertial reference frame, and wherein the door handle assembly is subject to an impact that generates an inertial force F1 in a first direction.
Figure 8:
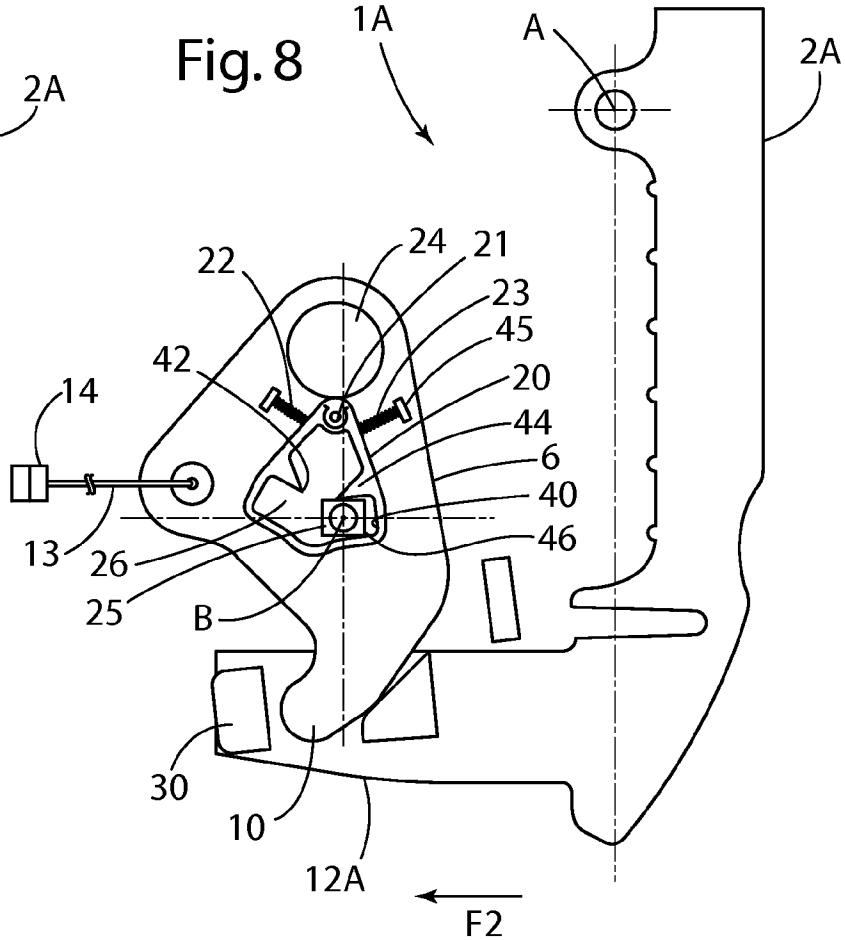
FIG. 8 is a view of the door handle assembly of FIG. 3 wherein the handle assembly shown in a non-inertial reference frame, and wherein the door handle assembly has been subject to an impact that generates an inertial force F2 in a second direction that is opposite the first direction.

With further reference to FIG. 5, if the handle assembly 1A is subject to an impact/acceleration causing an inertial force F1, the force F1 tends to shift the handle assembly 1A in the direction of the force F1. Also, the force F1 acts on lock member 20 and causes it to rotate in a counterclockwise direction about pin or pivot 21 relative to bell crank 6, overcoming the centering bias force of springs 22 and 23. Rotation of lock member 20 relative to bell crank 6 causes the engagement member 25 to be positioned in end portion 27 of cavity 26 of locking member 20. Side surfaces 31, 32, and 33 of end portion 27 of cavity 26 fit closely around the outer surfaces 34, 35, and 36, respectively, of engagement member 25, and the lock member 20 therefore cannot rotate about engagement member 25 and axis B (pin 7). Also, because lock member 20 cannot rotate about axis B, bell crank 6 also cannot rotate about axis B due to the action of locking member 20. Accordingly, when an inertial force F1 is applied to the handle assembly 1A due to an impact, the lock member 20 rotates and locks the bell crank 6 and prevents rotation of bell crank 6. Thus, although the inertial forces on handle member 2A are transmitted to the end portion 10 of bell crank 6 by protrusion 30, these forces do not rotate bell crank 6 or release latch 14 due to the locking action of lock member 20.

Figure 6:
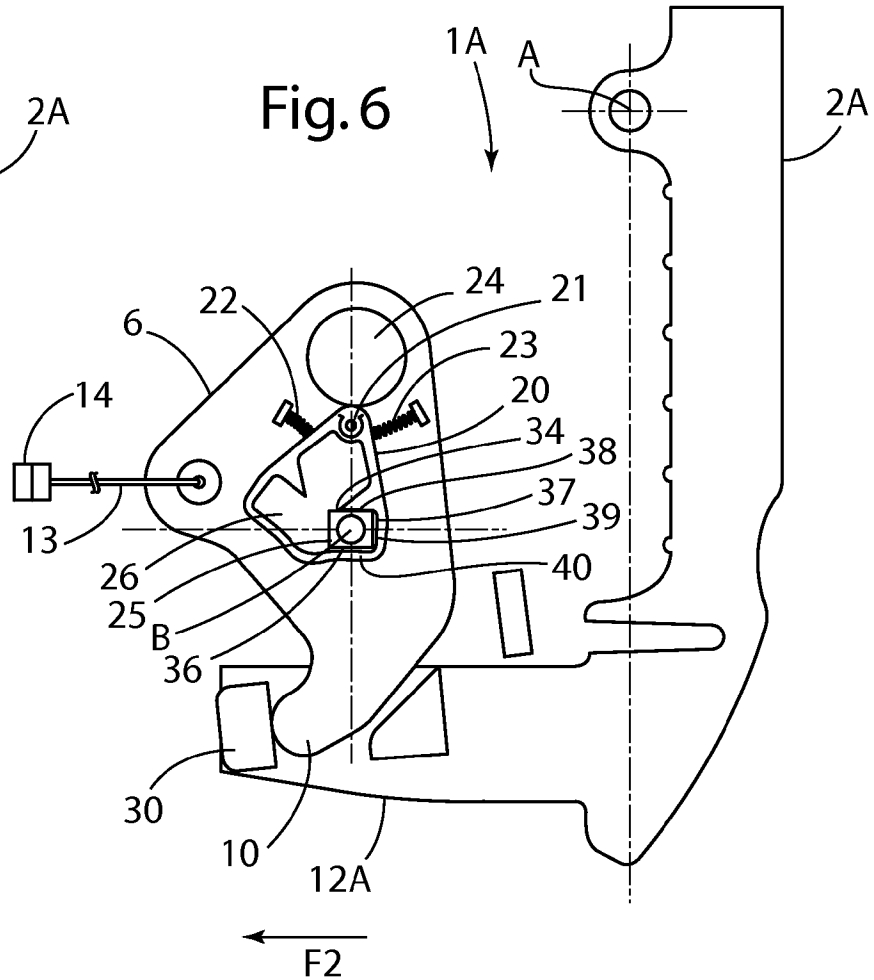
FIG. 6 is a partially schematic view of the door handle assembly of FIG. 3 wherein the door handle assembly is shown in a non-inertial reference frame, and wherein the door handle assembly is subject to an impact that generates an inertial force F2 in a second direction that is opposite the first direction.

With further reference to FIG. 6, if door handle assembly 1A is subject to an impact force generating an inertial force acting in a direction of the arrow "F2" that is opposite the inertial force F1 of FIG. 5, the lock member 20 rotates in a clockwise direction about the pin 21, and engagement member 25 will be disposed in the end portion 28 of cavity 26 of lock member 20. Due to the close fit between outer surfaces 35, 36, and 37 of engagement member 25, and inner side surfaces 38, 39, and 40, respectively, of cavity 26, lock member 20 cannot rotate about axis B, and bell crank 6 also cannot rotate about axis B.

Thus, the locking mechanism formed by the lock member 20 and engagement member 25 prevents rotation of bell crank 6 in the event the door handle assembly 1A is subject to inertial forces F1 (FIG. 5) or F2 (FIG. 6). The lock mechanism is therefore effective to prevent release of latch 14 in the event of inertial forces acting in opposite directions. During an actual impact, the inertial forces may initially be in the direction of the arrow F1, followed by rebound forces in the direction of the arrow F2. Also, many of the parts of the lock mechanism of the present invention may be utilized for both left and right-handed doors of vehicles without modification. For example, the same lock member 20 and engagement member 25 may be used for both right and left-hand doors of a vehicle, with only mirror-image bell cranks 6 being required for each side of the vehicle. Furthermore, because the mechanism prevents rotation of bell crank 6 regardless of the size, shape, and weight of the handle 2 or 2A, the same lock member 20, engagement member 25, springs 22 and 23, and bell crank 6 can be utilized in a wide range of applications having different door handle sizes, latch mechanisms 14, etc. This eliminates the need to custom design or adapt the mechanism utilizing different counter weights, etc. as may be required with known lock mechanisms.

Figure 7:
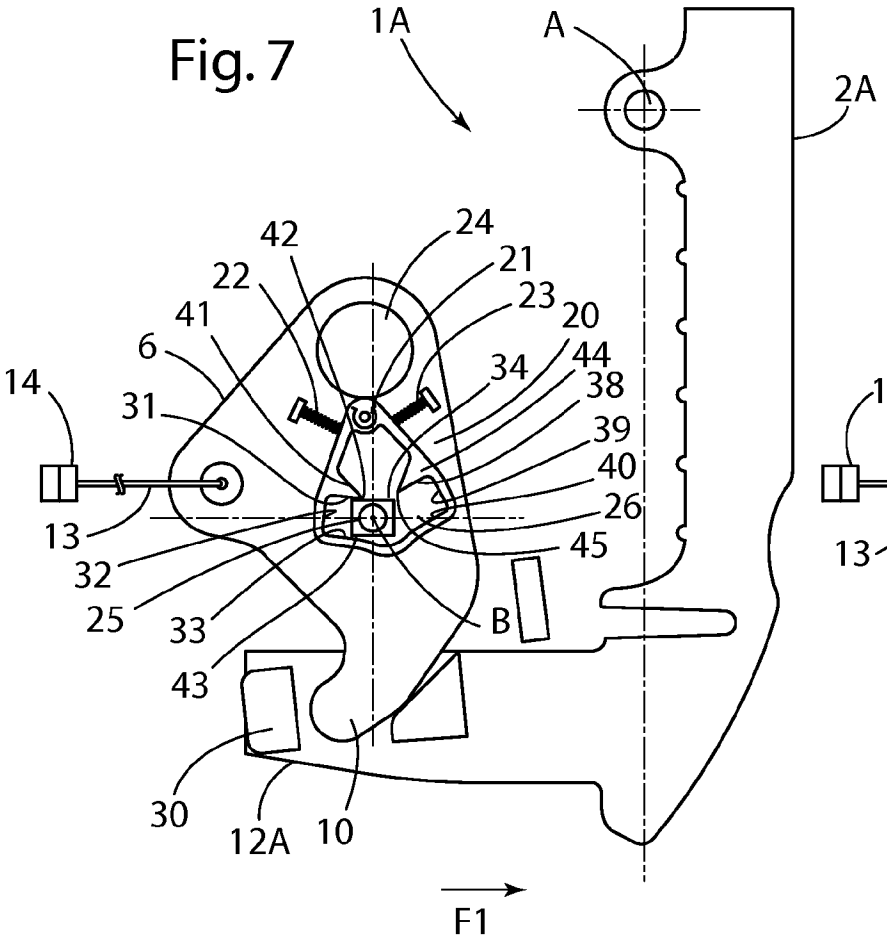
FIG. 7 is a view of the door handle assembly of FIG. 3 wherein the handle assembly is shown in a non-inertial reference frame, and wherein the door handle assembly has been subject to an impact that generates an inertial force F1 in the first direction.

With further reference to FIG. 7, if an inertial force F1 is applied to the door handle assembly 1A, lock member 20 may initially rotate about pin or pivot 21, and a point or tip 42 of projection 41 of lock member 20 may contact outer surface 34 of engagement member 25 (i.e. rotation of bell crank 6 may occur before lock member 20 rotates to the fully engaged position relative to engagement member 25 shown in FIG. 5). In this situation, corner 43 of engagement member 25 may contact side surface 33 of cavity 26. Although contact between lock member 20 and engagement member 25 may prevent rotation of lock member 20 to the position shown in FIG. 5, contact between lock member 20 and engagement member 25 will nevertheless prevent rotation of lock member 20 about axis B, thereby preventing rotation of bell crank 6 about axis B. Similarly, with further reference to FIG. 8, if an inertial force F2 is applied in an opposite direction, contact between point or tip 45 of projection 44 of lock member 20 and engagement member 25, as well as contact between a corner 46 of engagement member 25 and side surface 40 of cavity 26, prevents rotation of lock member 20 about axis B, and also prevents rotation of bell crank 6 about axis B.

Figure 10:
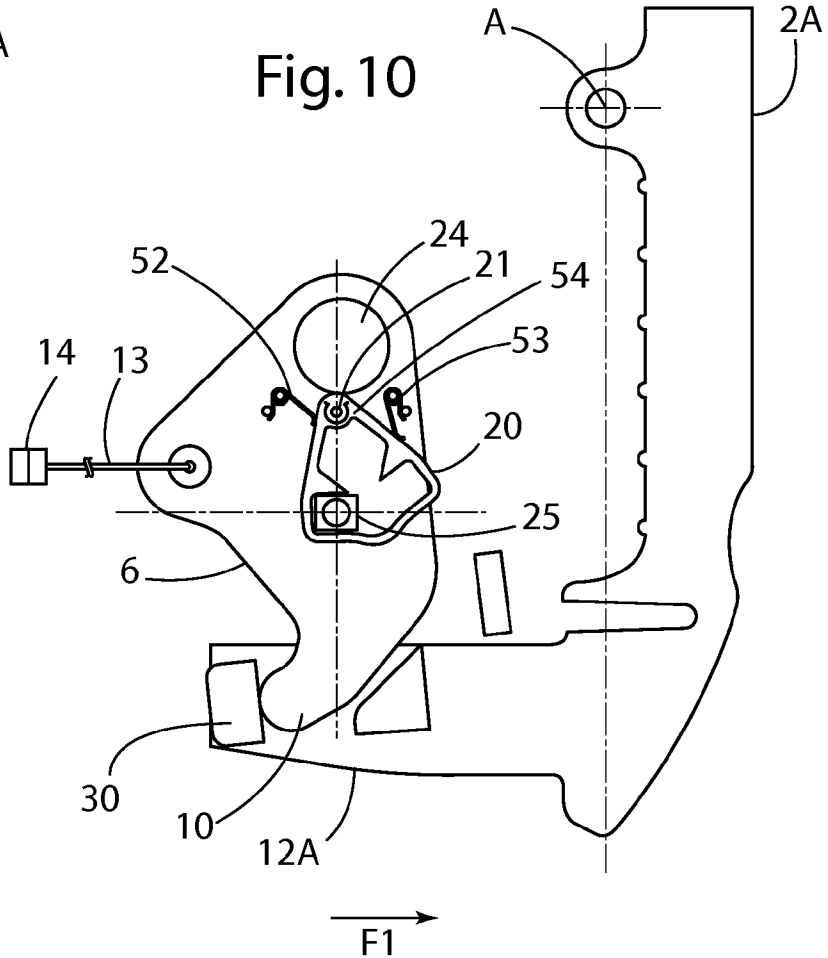
FIG. 10 is a partially schematic view of the door handle assembly of FIG. 9 wherein the door handle assembly is shown in a non-inertial reference frame, and wherein the door handle assembly has been subject to an impact that generates an inertial force F1 acting in a first direction.
Figure 9:
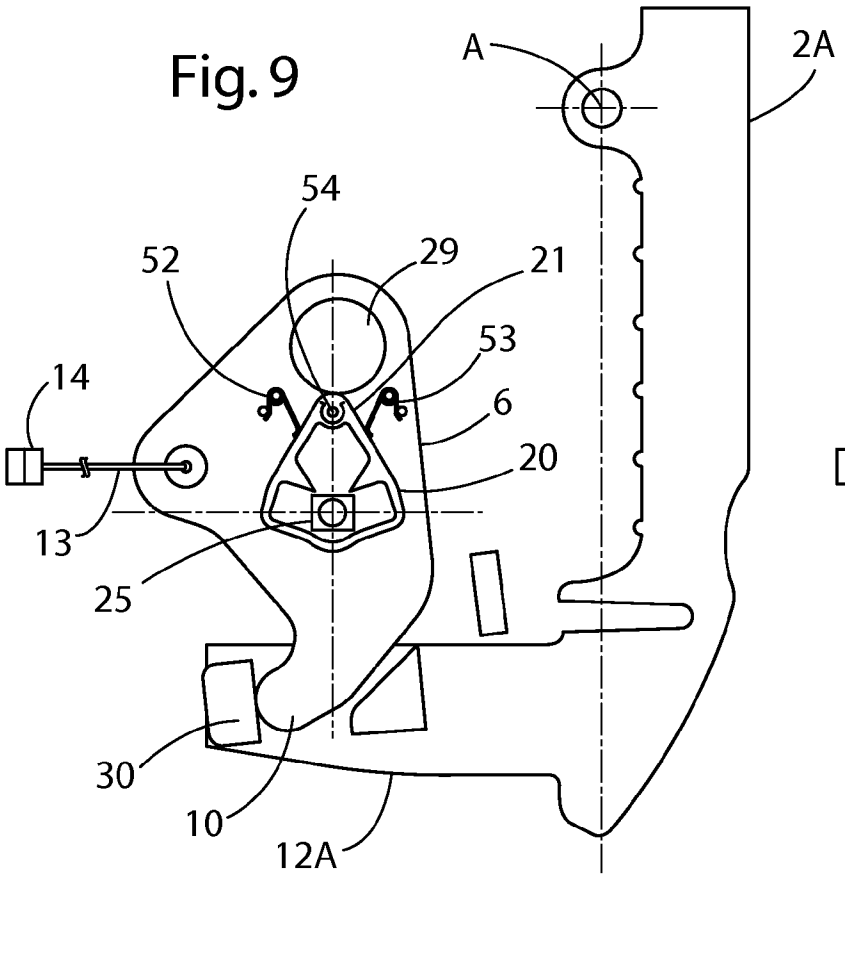

With further reference to FIGS. 9 and 10, springs 52 and 53 may be utilized in place of springs 22 and 23 described in more detail above in connection with FIGS. 1-8. Still further, one or more torsion springs 54 may be positioned at pin 21 to generate a centering bias on lock member 20. The springs 52 and 53 operate in substantially the same manner as springs 22 and 23 discussed in more detail above. Similarly, torsion spring(s) 54 may also provide a force biasing lock member 20 to the center position shown in FIG. 9. In general, torsion spring(s) 54 may be utilized instead of springs 22, 23 and springs 52, 53, or it may be utilized in combination with other springs.

Figure 11:
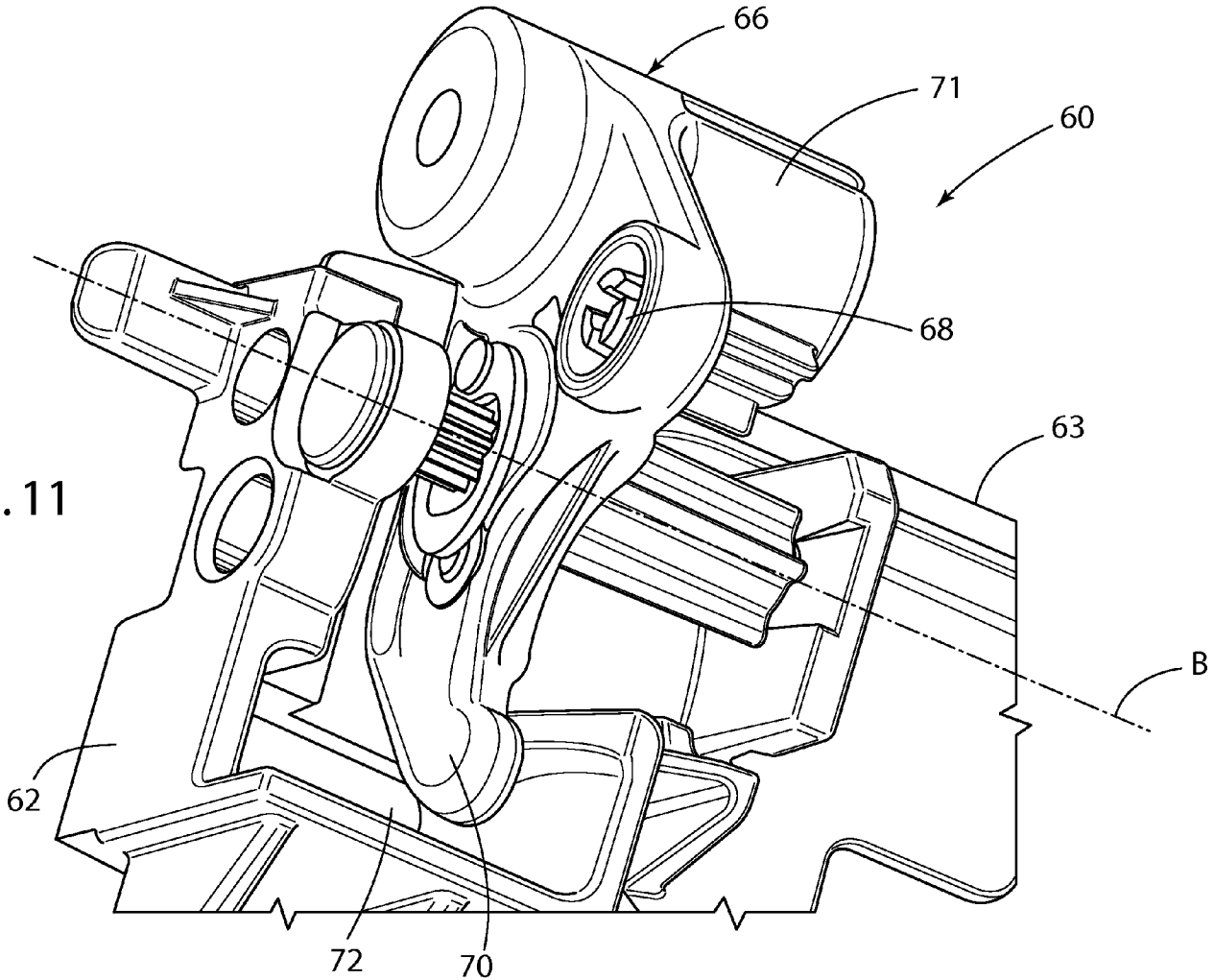
FIG. 11 is a partially fragmentary isometric view of a portion of a door handle assembly according to another aspect of the present invention.

With further reference to FIG. 11, a door handle assembly 60 according to another aspect of the present invention includes a bell crank 66 that is rotatably mounted to a door structure 63 for rotation about a horizontal axis "B." An end portion 70 of bell crank 66 is configured to engage an end portion 72 of a door handle member 62, such that rotation of door handle member 62 causes rotation of bell crank 66. A connector 68 of bell crank 66 may be connected to a linkage assembly to actuate a door latch in substantially the same manner as described in more detail above in connection with FIGS. 1-10.

The door handle assembly 60 of FIG. 11 is illustrated in FIGS. 12-15 in a partially schematic format wherein the axis of rotation B of bell crank 66 and the axis of rotation A of door handle 62 are shown as being in parallel. Although the preferred orientation of axes A and B is perpendicular to one another as shown in FIG. 11, the axes A and B have nevertheless been shown as being parallel to one another in FIGS. 12-15 to more clearly show the operation of the door handle assembly 60 (designated "60A" in FIGS. 12-15).

Figure 12:
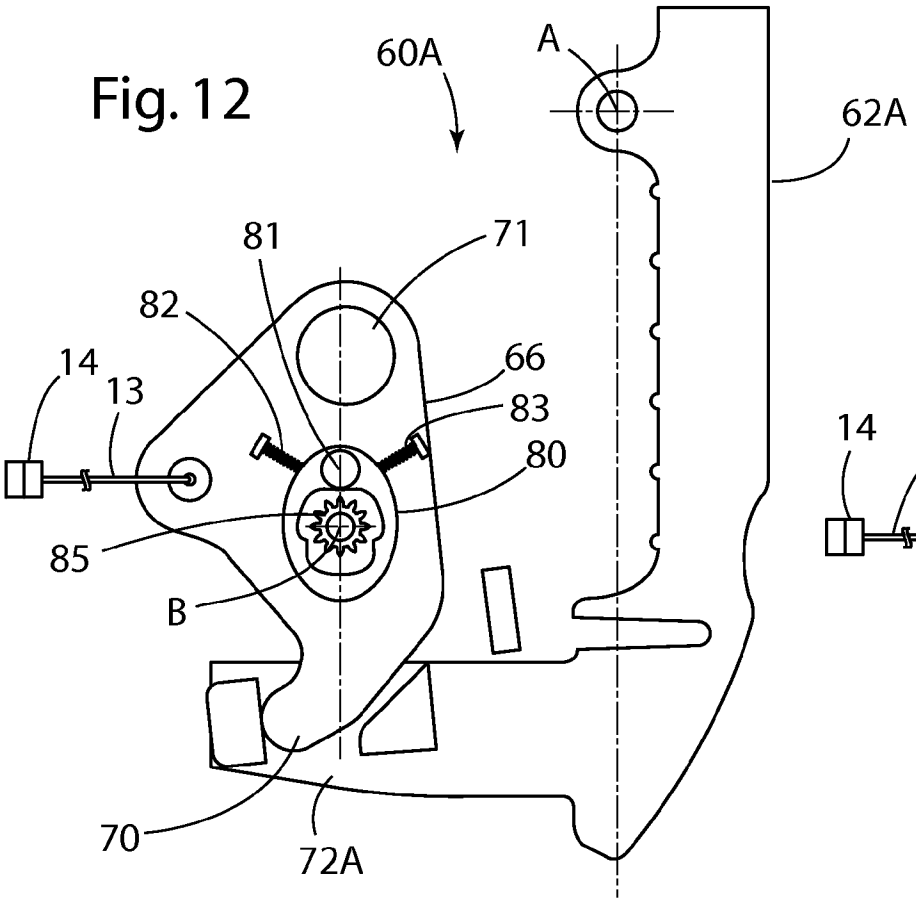
FIG. 12 is a partially schematic view of the door handle assembly of FIG. 11 wherein the door handle assembly is not subject to an impact force, and wherein the handle assembly has also not been manually actuated by a user.

With reference to FIG. 12, door handle assembly 60A includes a locking member 80 that is somewhat similar to the locking member 20 described in more detail above in connection with FIGS. 1-10, and engagement member 85 that is somewhat similar to the engagement member 25 described in detail above in connection with FIGS. 1-10. Lock member 80 is rotatably connected to bell crank 66 by a pin 81, and springs 82 and 83 bias lock member 80 to the center position shown in FIG. 12. When there is no force applied to handle member 62A by a user, and the handle assembly 60A has also not experienced an inertial force, the handle assembly 60A is disposed in the position shown in FIG. 12. This configuration or position is substantially similar to the position of door handle assembly 1A in FIG. 3.

Figure 13:
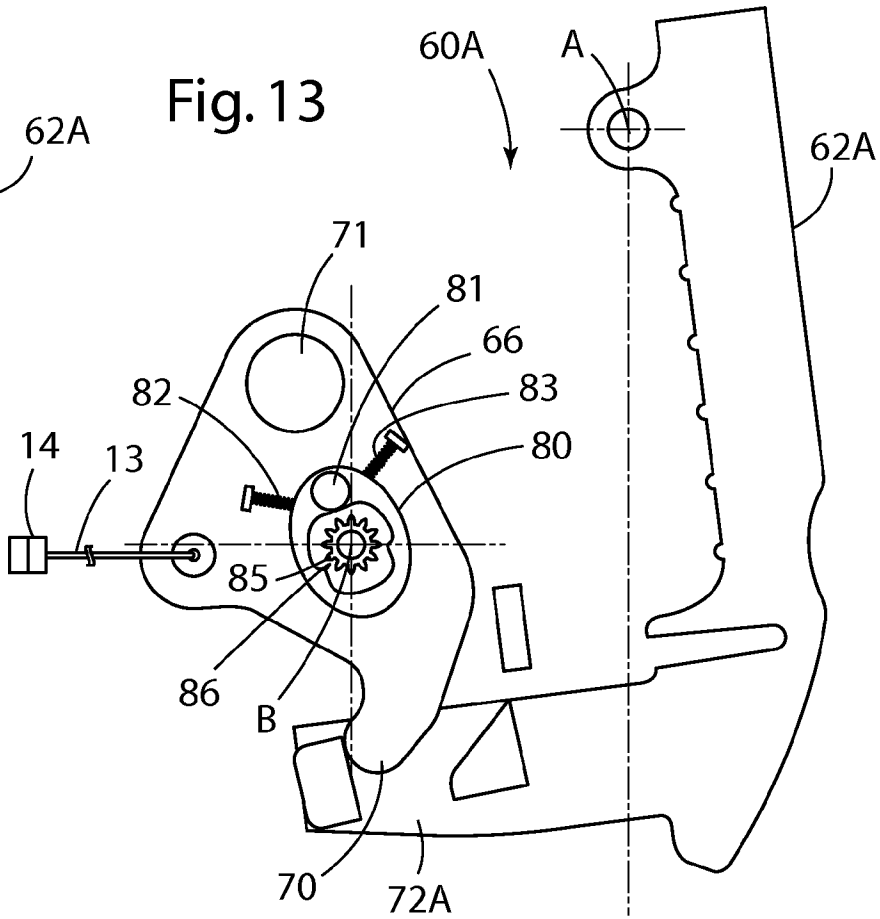
FIG. 13 is a partially schematic view of the door handle assembly of FIG. 12 wherein the door handle has been manually pulled outwardly by a user.

As shown in FIG. 13, when a user pulls on handle 62A, the handle 62A rotates about axis A, causing end portion 72A of handle 62A to engage end 70 of bell crank 66, thereby rotating bell crank 66 about axis B. Rotation of bell crank 66 causes linkage 13 to shift, thereby actuating door latch 14. During manual operation of the door handle assembly 60A, lock member 80 rotates with bell crank 66 as shown in FIG. 13 due to the centering bias of springs 82 and 83.

Figure 14:
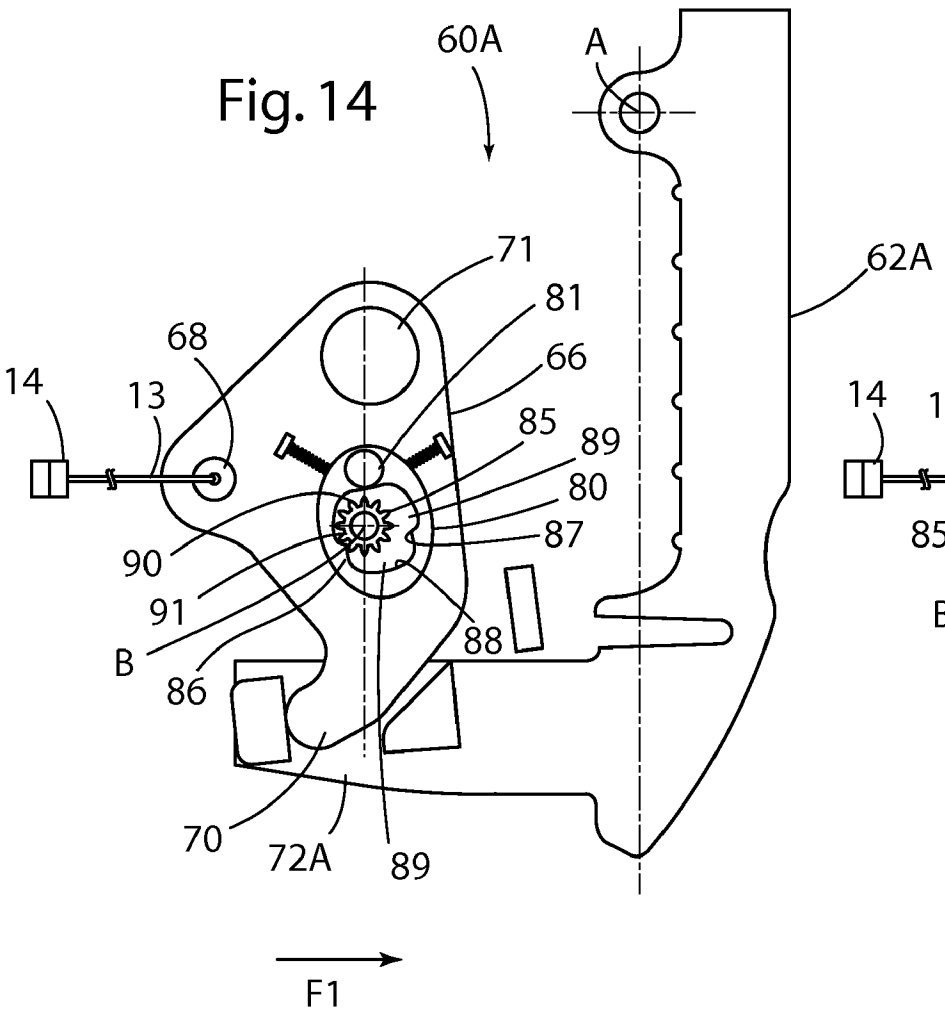
FIG. 14 is a partially schematic view of the door handle assembly of FIG. 12 in a non-inertial reference frame, and wherein the door handle assembly has been subject to an impact force generating an inertial force F1 acting in a first direction.

With further reference to FIG. 14, if handle assembly 60A experiences an inertial force F1 due to an impact or the like, lock member 80 will rotate about pin 81, causing a point or tip 86 formed in a side wall 88 of cavity 89 in lock member 80 to contact/engage engagement member 85. Engagement member 85 includes a plurality of teeth 90, such that point or tip 86 engages a space 91 between a pair of adjacent teeth 90 upon rotation of lock member 80 to the position shown in FIG. 14. Engagement of point or tip 86 with teeth 90 prevents rotation of lock member 80 about axis B, and the interaction between lock member 80 and bell crank 66 prevents rotation of bell crank 66. Similarly, if the door handle assembly 60A is subject to an inertial force F2 (FIG. 15) in a direction that is opposite inertial force F1 (FIG. 14), lock member 80 will rotate about pin 81 to the position shown in FIG. 15, thereby preventing rotation of bell crank 66 about axis B.

Figure 15:
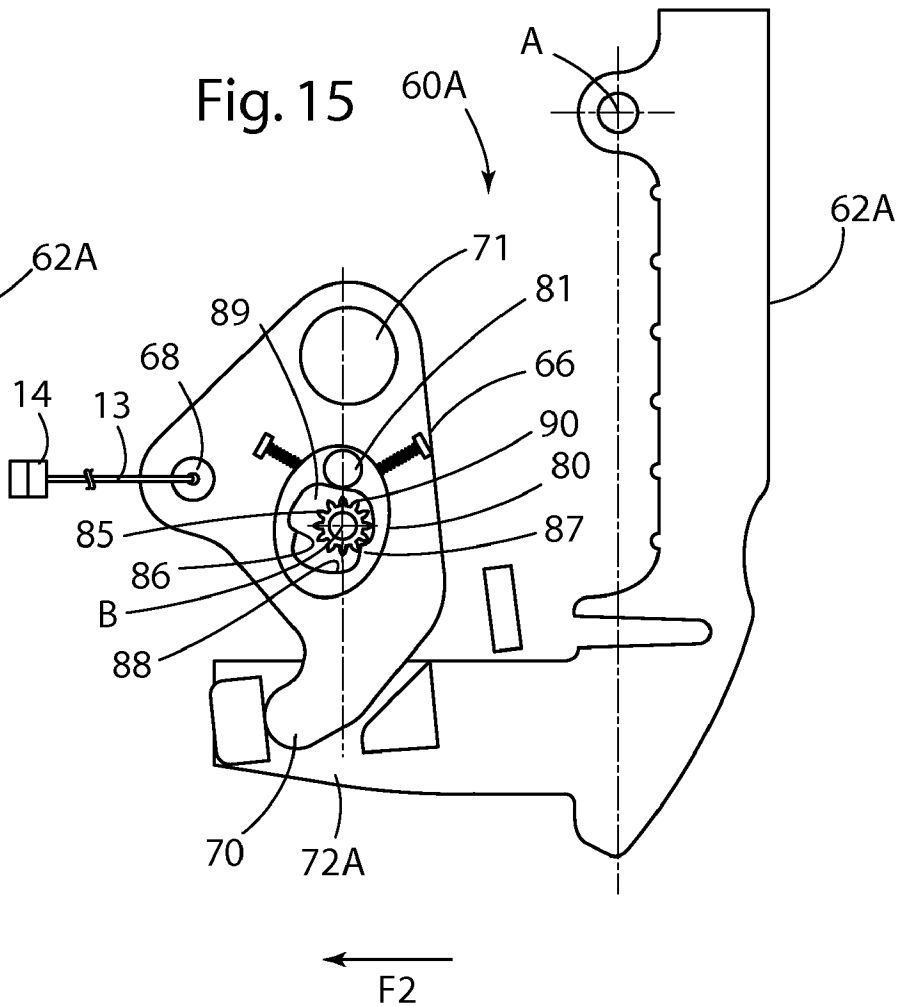
FIG. 15 is a partially schematic view of the door handle assembly of FIG. 14 in a non-inertial reference frame, and wherein the door handle assembly is subject to an impact force generating an inertial force F2 acting in a second direction that is opposite the first direction shown in FIG. 14.

Depending on the nature of the impact force experienced by the handle assembly 60A, door handle member 62A may begin to rotate somewhat about axis A before lock member 80 rotates to one of the fully locked positions of FIGS. 14 and 15. The handle member 62A may cause bell crank 66 to begin rotation before lock member 80 fully engages engagement member 85. However, because the engagement member 85 includes a plurality of teeth 90, the point or tips 86 and 87 of lock member 80 will engage the "next" space 91 between teeth 90 even if bell crank 60 has rotated somewhat relative to engagement member 85 before the lock member 80 reaches one of the fully engaged positions shown in FIGS. 14 and 15.

The inertia lock described above can be utilized for both left and right-hand door handles in a vehicle. Furthermore, the inertia lock design may be utilized for a wide range of door handle types and sizes, thereby providing a substantially universal design that can be utilized for a wide variety of vehicle door handle designs. Still further, the lock mechanism prevents release of the door latch even if an impact generates inertial forces acting in more than one direction.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A vehicle door assembly, comprising:

a door structure;

an engagement member fixed to the door structure;

a handle movably mounted to the door structure for movement between a first position and an actuated position;

a crank member rotatably mounted to the door structure for rotation about an axis extending through the engagement member, the crank member operably engaging the handle such that the handle causes the crank member to rotate from a first position to an actuated position upon rotation of the handle;

a door latch operably connected to the crank member whereby movement of the crank member releases the door latch;

a lock member pivotably mounted to the crank member configured to move between first and second positions relative to the crank member, the lock member further defining an intermediate position between the first and second positions, wherein the lock member is spring-biased towards the intermediate position and wherein the lock member is configured to move to the first and second positions upon acceleration of the vehicle door assembly generating inertial forces in first and second directions, respectively, to the lock member; and wherein:

the lock member engages the engagement member when the lock member is in the first position and when the lock member is in the second position and restricts movement of the crank member such that the door latch cannot be released by the crank member.

2. The vehicle door assembly of claim 1, wherein:

the engagement member has a non-circular cross sectional shape.

3. The vehicle door assembly of claim 2, wherein:

the engagement member has a generally quadrilateral cross sectional shape.

4. The vehicle door assembly of claim 3, wherein:

the lock member includes a cavity defining first and second opposite end portions, each end portion having inwardly facing surfaces that fit closely around the engagement member when the engagement member is disposed in the first and second opposite end portions, respectively, to thereby restrict rotation of the crank member relative to the engagement member.

5. The vehicle door assembly of claim 4, wherein:

the inwardly facing surfaces of the first and second end portions of the cavity each include a first generally planar end surface portion, and a pair of generally planar opposite surface portions extending transverse relative to the end surface portion.

6. The vehicle door assembly of claim 5, wherein:

the lock member is pivotally mounted to the crank member at a first end of the lock member for rotation about a lock axis, and the cavity is formed at a second end of the lock member.

7. The vehicle door assembly of claim 6, wherein:

the generally planar opposite surfaces at the first end portion of the cavity are parallel to one another, and the generally planar opposite surfaces at the second end portion of the cavity are parallel to one another, and wherein each of the generally planar opposite surfaces are tangent to an arc about the lock axis.

8. The vehicle door assembly of claim 7, wherein:

the cavity of the lock member includes a central portion, and wherein the engagement member is disposed in the central portion when the lock member is in the intermediate position, and wherein the lock member rotates about the engagement member without contact between the lock member and the engagement member when the engagement member is disposed in the central portion of the cavity.

9. The vehicle door assembly of claim 2, wherein:

the engagement member comprises a gear having a plurality of teeth.

10. The vehicle door assembly of claim 9, wherein:

the teeth form a generally circular perimeter.

11. The vehicle door assembly of claim 1, including:

at least one spring biasing the lock member to the intermediate position.

* * * * *

UNITED STATES PATENT AND TRADEMARK OFFICE

CERTIFICATE OF CORRECTION

PATENT NO. : 8,322,077 B2
APPLICATION NO. : 12/623762
DATED : December 4, 2012
INVENTOR(S) : Kosta Papanikolaou et al.

It is certified that error appears in the above-identified patent and that said Letters Patent is hereby corrected as shown below:

Title Page
Item (73) Assignee:
"Ford Global Technologies, LLC" should be --Ford Global Technologies, LLC and ADAC Plastics, Inc.--

Signed and Sealed this
Twenty-eighth Day of April, 2015

Michelle K. Lee

Michelle K. Lee
*Director of the United States Patent and Trademark Office*